US005875220A

United States Patent [19]

Zhuikov et al.

[11] Patent Number: 5,875,220

[45] Date of Patent: Feb. 23, 1999

[54] PROCESS FOR PRODUCTION OF RADIOSTRONTIUM

[75] Inventors: Boris Leonidovich Zhuikov, Troitsk; Vladimir Mikhailovich Kokhanjuk, Narofominsk, both of Russian Federation; John Vincent, Vancouver, Canada

[73] Assignee: Institut Yadernykh Issledovany Rossiiskoi Akademii Nauk, Moscow, Russian Federation

[21] Appl. No.: 869,247

[22] Filed: Jun. 4, 1997

[30] Foreign Application Priority Data

Jun. 4, 1996 [RU] Russian Federation ..... 96111762

[51] Int. Cl.[6] ..... G21G 1/10

[52] U.S. Cl. ..... 376/195; 376/189; 210/679; 210/682

[58] Field of Search ..... 376/194, 195, 376/198, 201, 189; 210/672, 679, 682

[56] References Cited

U.S. PATENT DOCUMENTS

| | | | |
|---|---|---|---|
| 2,890,932 | 6/1959 | Lowe | 23/145 |
| 5,637,506 | 6/1997 | Goken et al. | 210/682 |
| 5,691,211 | 11/1997 | Sorensen et al. | 210/682 |
| 5,711,015 | 1/1998 | Tofe | 210/682 |

OTHER PUBLICATIONS

Mausner et al., "Production of $^{82}$Sr by Proton Irradiation of RbC1*", Appl. Radiat. Isot., vol. 38, No. 3, pp. 181–184, 1987.

Cackette et al., "$^{82}$Sr Production from Metallic Rb Targets and Development of an $^{82}$Rb Generator System", Appl. Radiat. Isot., vol. 44, No. 6, pp. 917–922, 1993.

Zhuikov et al., "Production of Strontium–82 In Russia", Proceedings Sixth Workshop on Targetry and Target Chemistry, pp. 112–113, Aug. 1995.

*Primary Examiner*—Harvey E. Behrend
*Attorney, Agent, or Firm*—Pennie & Edmonds LLP

[57] ABSTRACT

A process for the production of radiostrontium consists in that a target of metallic rubidium is bombarded by a flow of accelerating charged particles. The target of irradiated rubidium is melted, whereas the extraction of radiostrontium is carried out by sorption on the surface of a sorbing material immersed into the irradiated molten metallic rubidium. As the sorbing material, use is made of materials selected from the group consisting of heat-resistant metals or metallic oxides or silicon which are inert with respect to rubidium. The resultant radiostrontium is extracted from the irradiated rubidium. The temperature of the sorbing material is selected to be close to the optimum one for the sorption of radiostrontium which is within the range of from the melting point of metallic rubidium to 220° C. And the temperature of molten rubidium is selected to be close to the optimum one for the desorption of radiostrontium within the range of from 220° C. to 270° C.

2 Claims, 1 Drawing Sheet

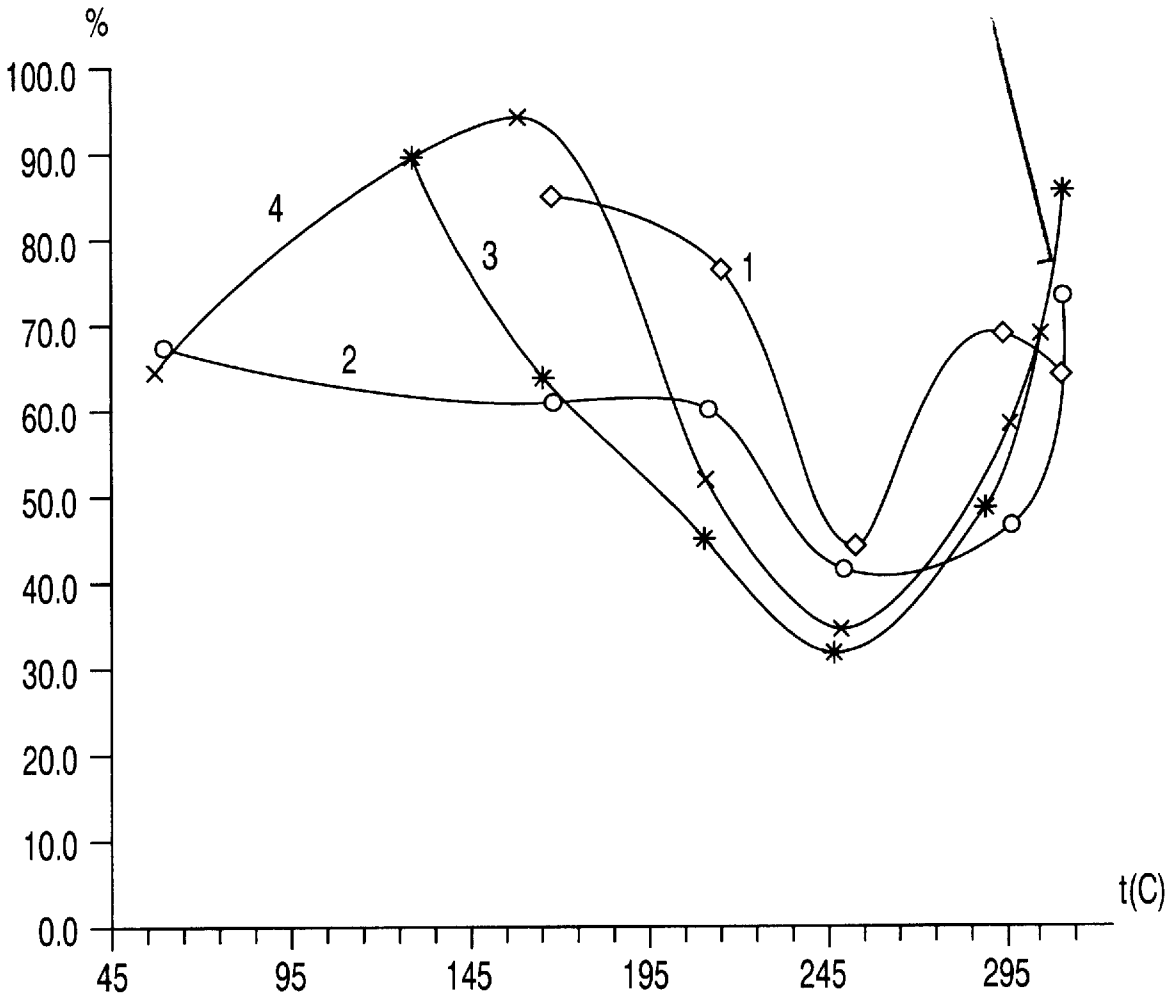
%
100.0
90.0
80.0
70.0
60.0
50.0
40.0
30.0
20.0
10.0
0.0
45
95
145
195
245
295
t(C)
1
2
3
4

PROCESS FOR PRODUCTION OF RADIOSTRONTIUM

FIELD OF THE INVENTION

The invention relates to radiochemistry and more specifically, to a process for the production and extraction of pure radiostrontium (Strontium 82 or 85) which is widely used in medicine to diagnose a number of diseases with the use of positron emission tomography.

BACKGROUND OF THE INVENTION

A process is known in prior art to be used for the production of radiostrontium (see, for instance, L. F. Mausner, et al., Rad. and Isot. Journal, Vol. 38, 1987, pp. 181–184), said process comprising the steps of bombarding by accelerating protons relatively thin targets of rubidium chloride, and extracting radiochemically radiostrontium therefrom. The shortcomings of the above-mentioned process consist in complexity of extracting radiostrontium, insufficient efficiency, corrosion and radiation decomposition of the target material.

The closest technical solution is furnished by a process for the production of radiostrontium, said process comprising bombarding a target of metallic rubidium by a beam of accelerating charged particles, followed by extracting the resultant radiostrontium from rubidium by a radiochemical method (see, M. R. Cackette, T. J. Ruth, J. S. Vincent "Sr-82 Production from Metallic Rb Targets and Development of an Rb-82 Generator System", Journal "Applied Radiation and Isotopes", Vol. 44, p.p. 917–922, 1993).

The shortcoming of the above-mentioned process also consists in complexity of extracting radiostrontium and insufficient efficiency.

SUMMARY OF THE INVENTION

In the basis of the present invention is put a problem of improving efficiency of the production of radiostrontium and simplifying the technology of its extraction when a metallic rubidium target is used, through a sorption extraction of radiostrontium directly from liquid rubidium.

The problem thus posed is solved owing to that, in the process for the production of radiostrontium, according to the invention, the target of metallic rubidium bombarded by a beam of accelerating charged particles is melted, whereas the extraction of radiostrontium is carried out by sorption on the surface of a sorbing material immersed into the irradiated molten metallic rubidium, wherein as the sorbing material, use is made of materials selected from the group consisting of heat-resistant metals or metallic oxides or silicon which are inert with respect to rubidium. The temperature of the sorbing material is selected to be close to the optimum one for the sorption of radiostrontium which is within the range of from the melting point of metallic rubidium to 220° C., and the temperature of the molten rubidium is selected to be close to the optimum one for the desorption of radiostrontium within the range of from 220° C. to 270° C.

DESCRIPTION OF THE DRAWING

The invention will further be illustratively described by way of examples which show specific embodiments thereof with reference to the accompanying drawing, in which:

FIG. 1 depicts how the sorption of radiostrontium by various materials depends on temperature.

DETAILED DESCRIPTION OF THE PREFERRED EMBODIMENTS

A target of metallic rubidium is bombarded by a beam of accelerating charged particles, for instance, protons, and then is melted. Radiostrontium is extracted from the target by sorption on the surface of a sorbing material immersed into the molten metallic rubidium at various temperatures. As the sorbing material, use is made of heat-resistant metals or metallic or silicon oxides which are inert with respect to rubidium, for instance, glass, stainless steel, titanium, nickel, aluminium.

The temperature of the sorbing material is selected to be close to the optimum one for the sorption of radiostrontium within the range of from the melting point of metallic rubidium to 220° C.

Along with this, the temperature of molten rubidium is selected to be close to the optimum one within the range of from 220° C. to 270° C.

EXAMPLE 1

To determine the sorption properties of sorbing materials, they were put into glass weighing bottles and nickel beakers, whereupon liquid rubidium produced from the molten irradiated target was poured therein. All the beakers and bottles were thermostatted in a flow of heated-up helium or by electric heaters at a temperature of 50° C. for as long as 3 hours.

As the sorbing material, the following materials were tested: "Thermoxide-34" based on $ZrO_2$, "Thermoxide-50" based on $TiO_2$, "Thermoxide-230" based on $SnU_2$, aluminium oxide, tungsten, niobium, titanium, molybdenum, stainless steel, glass, copper, gold, zirconium.

After completing the experiment the liquid rubidium was poured off, the sorbing material was taken out and, by means of a Ge(Li) detector, the content of strontium and rubidium was measured in each specimen. The content of strontium was determined from isotopes Sr-82 (776 keV and 511 keV lines) and Sr-83 (a 763 keV line), and that of rubidium, from isotope Rb-84 (880 and 552 keV lines). The results of these experiments are presented in Table 1.

TABLE 1

Distribution of radiostrontium and rubidium on glass weighing bottles and nickel beakers at 50–57° C. for 3 hours

| Sorbing material | Weight of sorbing material, θ | Area of sorbing material, $cm^2$ | Area of bottle, $cm^2$ | Sample | Sr-82 % | Rb-84 % |
|---|---|---|---|---|---|---|
| $ZrO_2$ (activated) | 4.1 | porous | 12.6 | Sorbing material | 74.4 | 16.9 |
| | | | | Glass weighing bottle | 25.6 | 1.7 |
| | | | | Residue | <3 | 81.3 |
| $ZrO_2$ (not activated) | 0.40 | porous | 12.6 | Sorbing material | 48.9 | 24.2 |
| | | | | Glass weighing bottle | 38.7 | 2.6 |
| | | | | Residue | 12.4 | 73.2 |
| $TiO_2$ (not activated) | 1.7 | porous | 10.1 | Sorbing material | 57.6 | 17.7 |
| | | | | Glass weighing bottle | 42.4 | 5.8 |
| | | | | Residue | <2 | 76.5 |

TABLE 1-continued

| Distribution of radiostrontium and rubidium on glass weighing bottles and nickel beakers at 50–57° C. for 3 hours | | | | | | |
|---|---|---|---|---|---|---|
| Sorbing material | Weight of sorbing material, θ | Area of sorbing material, $cm^2$ | Area of bottle, $cm^2$ | Sample | Sr-82 % | Rb-84 % |
| Titanium (foil) | 0.056 | 1.5 | 6.3 | Sorbing material | 11.3 | <0.5 |
| | | | | Glass weighing bottle | 28.7 | 100 |
| | | | | Residue | | |
| Tungsten (foil) | 0.37 | 2.5 | 10.1 | Sorbing material | 12.7 | 0.1 |
| | | | | Glass weighing bottle | 44.1 | 0.6 |
| | | | | Residue | 43.2 | 99.3 |
| Stainless steel (clean non-oxidized foil) | | 3.9 | | Sorbing material | 36 | 1 |
| | | | | Nickel beaker | 36 | 3 |
| | | | | Residue | 28 | 96 |

Strontium-82 is sorbed on the materials to various degrees, in this case, the yield on porous sorbents exceeds 92%.

EXAMPLE 2

Radiostrontium was sorbed on various materials with a smooth surface at hight temperature of liquid rubidium. For this purpose, beakers of various materials were put into the cells of an aluminium block, one edge of the block was heated by electric heaters, and the opposite edge thereof was cooled with water in a passage of the block. The temperature in the cells varied within 125° C. to 308° C. Thus, it was plotted how the sorption depends on temperature for stainless steel, nickel, titanium and glass. The duration of this experiment was 3 hours. The results are presented in FIG. 1.

The maximum yield on many materials was reached at 150° C. to 170° C., it amounted, for instance, to 96% for stainless steel at 160° C. There is also a second maximum for the yield of strontium (about 300° C., or higher). However, carring out experiments at such a high temperature involves technical difficulties. At a temperature of 240° C. to 270° C., the sorption of strontium was at minimum.

EXAMPLE 3

Radiostrontium was extracted from a target containing molten metallic rubidium by sorption on the surface of a sorbent, the temperature of which was maintained different from that of rubidium. In this case, radiostrontium was sorbed on the surface of various materials, including also on the walls of the target shell made of stainless steel. Two nickel rods used as a sorbent were in turn inserted inside the molten rubidium. The surface area of each rod was 3.8 $cm^2$, and the area of the inner walls of the target shell was 24.5 $cm^2$. In so doing, the temperature of the rods was maintained to be close to the optimum one for sorption, and the temperature of the target was maintained to be close to the optimum one for desorption from the walls of the shell. The walls of the target shells were heated to 255°–275° C., and the rod was at the same time cooled to maintain a temperature thereof within 122° C. to 130° C., and these conditions correspond to the minimum and maximum values of sorption for stainless steel and nickel, respectively (FIG. 1).

The duration of sorption on each rod was 14 hours. On the surface of the first rod was separated out 79% and, on that of the second rod, 16% more so that in total this made up as much as 95% of Strontium-82 for 28 hours of sorption.

Use made of the present invention allows to ensure an improvement in efficiency of the production of radiostrontium and simplify the technology of its extraction when a liquid metallic rubidium target is used, through a sorption extraction of radiostrontium from rubidium.

We claim:

1. A process for the production of radiostrontium, said process comprising the following steps:

bombarding a target of metallic rubidium by a beam of accelerating charged particles, melting said irradiated target of metallic rubidium, immersing a sorbing material into said melt of metallic rubidium, extracting radiostrontium by sorption on the surface of said sorbing material, and using, as said sorbing material, a material selected from the group consisting of heat-resistant metals, metallic and silicon oxides, said material being inert with respect to said rubidium, and extracting the resultant radiostrontium.

2. The process as claimed in claim 1, wherein the temperature of said sorbing material is set to be close to the optimum one for the sorption of radiostrontium within the range of from the melting point of metallic rubidium to 220 deg.C., and the temperature of molten rubidium is set to be close to the optimum one for the desorption of radiostrontium within the range of from 220 deg.C. to 270 deg.C.

* * * * *